US005081777A

United States Patent [19]

Kim

[11] Patent Number: 5,081,777

[45] Date of Patent: Jan. 21, 1992

[54] PICTURE FRAME

[75] Inventor: Byung-Woong Kim, Sungnam, Rep. of Korea

[73] Assignee: Bowon Trading Co., Ltd., Seoul, Rep. of Korea

[21] Appl. No.: 601,893

[22] Filed: Oct. 22, 1990

[51] Int. Cl.[5] ..... A47G 1/06

[52] U.S. Cl. ..... 40/152; 40/652; 40/653

[58] Field of Search ..... 40/152, 152.1, 156, 40/157, 158.1, 620, 642, 652, 653; 403/326, 335, 375; 200/82

[56] References Cited

U.S. PATENT DOCUMENTS 3,294,429 12/1966 Halip ..... 40/152

4,467,543 8/1984 Townsend ..... 40/152

4,624,067 11/1986 Kristofich ..... 40/158.1

*Primary Examiner*—Kenneth J. Dorner

*Assistant Examiner*—Milton Nelson, Jr.

*Attorney, Agent, or Firm*—Cesari and McKenna

[57] ABSTRACT

A picture frame of the type having a frame member with a rearwardly extending peripheral flange and a back panel having an outer edge with the same general outline as the frame member and being arranged to seat against the frame member within the frame member flange includes one or more integral, resilient, cantilevered surface areas at the outer edge of the back panel each of which is arranged to resiliently engage a corresponding surface area of the frame member flange to releasably lock the back panel to the frame member when the former is seated against the latter.

4 Claims, 2 Drawing Sheets

PICTURE FRAME

FIELD OF THE INVENTION

This invention relates to a picture frame and more specifically to a picture frame with a removable back panel to facilitate insertion of a picture or photograph into the frame.

BACKGROUND OF THE INVENTION

Picture frames of the type designed to display small pictures and photographs usually include a frame member or bezel which defines a window, a sheet of transparent material filling the window and a back panel for holding the picture or photograph flat against the transparent sheet so that the picture is displayed in the window. Usually the back panel is removable to facilitate the placement and replacement of the picture in the picture frame.

The back panel may be mounted to the frame member in a variety of ways depending upon the type of frame and its cost. Some frames, particularly rectangular rolled metal ones, are provided with side and top flanges and a slot at the bottom edge of the frame member which define a keyway or slide at the back of the frame. After placing the picture in the frame window, the back panel is secured to the frame by sliding it into the keyway through the bottom slot. This type of frame construction is disadvantaged in that it can only be used on frames which are more or less rectangular. Also, the slot at the bottom of the frame member prevents the frame from having a finished edge all around its perimeter. Still further, the extra metal required to form the keyway adds to the cost of the frame.

Another conventional picture frame has a back panel which is adhered to the back of the frame member. The back panel has an opening located behind the frame window for receiving the picture and which may be closed by a drop-in cover which is retained in place by turn buttons. A major drawback of this type of frame is cost in that the finishing of the cover and the installation of the turn buttons involve time consuming manual operations.

Other types of picture frames have a back panel composed of two sections one of which is adhered to the back of the frame. The two sections are hinged together by a horizontal or vertical hinge so that the other section, located behind the frame window, can be flipped up or swung open like a book to facilitate inserting a picture into the frame. These hinged back panels are also limited to frames which are more or less rectangular.

There are also picture frames whose frame member has peripheral rearwardly extending flanges which surround the back panel, the back panel being retained in place by small pins or brads inserted into the edges of the back panel through tiny holes in those flanges. Although this type of back panel securement can be used on frames of more or less any shape and provides a finished edge all around the frame, the provision of holes for the pins and the installation of the pins add to the cost of the picture frame. Also the pins can become loose and lost if they are removed and replaced a number of times to change the picture displayed in the picture frame.

SUMMARY OF THE INVENTION

Accordingly an object of this invention is to provide a picture frame incorporating improved means for releaseably securing the back panel to the frame member.

Another object of the invention is to provide a picture frame incorporating this securement which can be of substantially any shape.

Yet another object of the invention is to provide such a picture frame having a finished edge all around the perimeter of the frame.

A further object of the invention is to provide a picture frame of this general type which can be manufactured and assembled at minimum cost.

Another object of the invention is to provide a picture frame with a removable back panel and an integral locking mechanism for releasably engaging the back panel to the frame member.

Yet another object of the invention is to provide such a picture frame whose back panel can be engaged to and disengaged from the frame member a multiplicity of times without the locking mechanism losinq its effectiveness.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my picture frame includes an annular frame member having a central opening which defines a window for displaying a picture or photograph. The frame member has a rearwardly extending peripheral flange dimensioned to contain or surround the remaining components of the picture frame. These components include a transparent sheet which fills the window, a picture or photograph located behind the transparent sheet and a back panel positioned behind the picture which presses the picture flat against the transparent sheet and retains the picture in the frame window.

In accordance with this invention, special locking means are incorporated into the edge of the back panel and into the flange of the frame member to releasably lock the back panel to the frame member. More particularly, the back panel is provided with one or more small, integral, cantilevered arms which extends parallel to, and in the plane of, the back panel edge margin.

In one frame embodiment, there is present at the free end of each arm at the edge of the back panel a small nub or projection which projects out beyond the adjacent edge of the back panel. Each cantilevered arm is flexible and resilient in that its free end can be moved inwardly toward the center of the back panel thereby depressing the nub at the end of that arm so that it is more or less even with the adjacent edge of the back panel. When released, the arm will spring back to its normal unstressed position so that the nub again projects beyond the adjacent edge of the back panel.

The other element of the locking means in this first frame embodiment is one or more small dimples or depressions formed integrally in the inner surface of the frame member flange at a location therearound which corresponds to the location of each depressable nub formed on the back panel. For example, if there is a nub located at the uppermost point on the back panel, there is a corresponding dimple located at the uppermost point of the frame member flange.

Thus when the back panel is set into the back of the frame member and those two members are pressed together, each nub will be depressed when engaged by the edge of the frame member flange as the back panel seats against the frame member. When each nub is brought opposite to the corresponding dimple formed in the frame member flange, that nub will snap outward into the dimple thereby locking the back panel to the frame member. While most picture frames will incorporate several such resilient locking means distributed around the picture frame to optimize the securement of the back panel to the frame member, in some instances a single such locking means may suffice.

In order to separate the back panel from the frame member in order to replace a picture in the picture frame, one holds the frame member at the location of one of the dimples therein and pushes against the transparent sheet adjacent to that dimple. This pushing force is transmitted to the back panel giving rise to a wedging action between the rear wall of that dimple and the cantilevered nub projecting into the dimple. That wedging action depresses the nub enough to allow the nub to clear the dimple so that the adjacent edge segment of the back panel can be pushed out from within the frame member flange. Usually the release of one or two of the nubs from their corresponding dimples suffices to release the entire back panel from the frame member.

In a second frame embodiment, the cantilevered nubs on the back panel may be replaced by cantilevered flats with beveled front and rear edges and the dimples in the frame member flange may be replaced by inwardly extending detents or projections located adjacent to the rear edge of that flange. When the back panel is pressed against the frame member to assemble the frame, the projections on the frame member flange will engage and depress the corresponding cantilevered flats on the back panel. When the back panel is seated, the projections will clear the flats, allowing the resilient cantilevered arms to flex outward so that the projections engage behind the flats thereby releasably locking the back panel to the frame member.

These locking mechanisms are advantaged in that they can be used on a picture frame of substantially any shape and they allow the frame member to have a finished edge all around the perimeter of the picture frame. The dimples or indents that are present on the frame member flange are barely noticeable. In fact, they are less noticeable than the pins that are present on comparable picture frames in present day use. Yet, the incorporation of these back panel locking mechanisms of this type into a picture frame results in a cost saving because the cantilevered nub or flat and the dimple or detent components of the locking mechanism are formed integrally in the back panel and frame member, respectively, when those parts are made, with substantially no extra material being required to form those parts. Furthermore, being integral to the frame per se, those parts cannot become lost or misplaced over time or lose their locking effectiveness.

BRIEF DESCRIPTION OF THE DRAWINGS

For a fuller understanding of the nature and objects of the invention, reference should be had to the following detailed description taken in connection the accompanying drawings, in which.

DETAILED DESCRIPTION OF PREFERRED EMBODIMENTS

Figure 1:
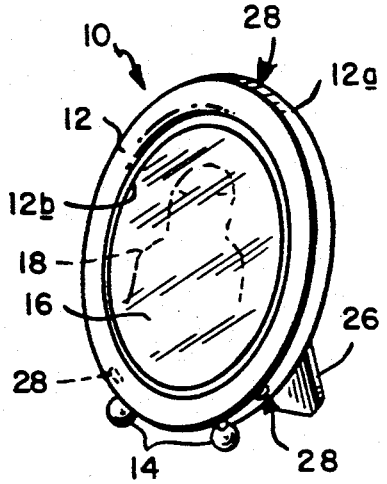
FIG. 1 is an isometric view of a picture frame incorporating my invention.

FIG. 1 illustrates a picture frame 10 incorporating my invention which is sized to display a small picture or photograph. The picture frame comprises an annular frame member 12 having a rearwardly extending peripheral flange **12*a* and a pair of ball feet 14 mounted to that flange at the bottom of the frame member. Those feet are designed to rest on a table or other horizontal surface. Frame member 12 may be made of metal, wood, plastic or any other relatively rigid material, the illustrated frame member 12 being a stamped metal part with a brass finish. While the frame member 12** is shown as being oval, it could be rectangular, heart-shaped or any other suitable shape.

Figure 2:
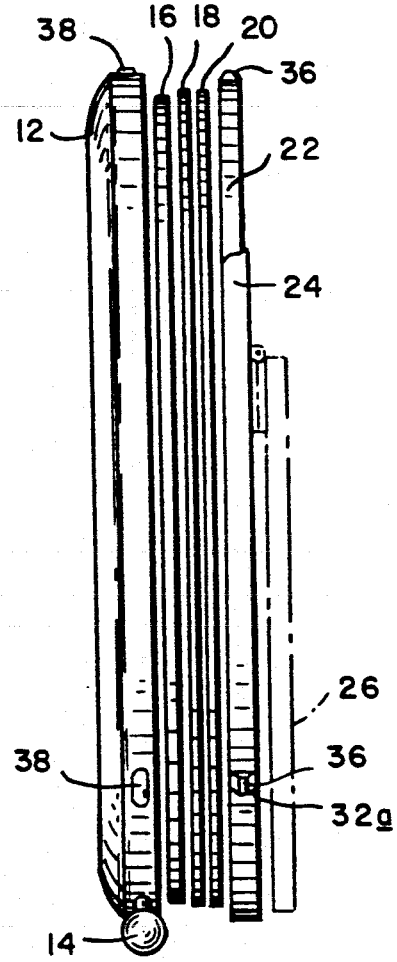
FIG. 2 is a exploded side elevational view on a larger scale of the FIG. 1 frame.

As shown in FIGS. 1 and 2, positioned just behind frame member 12 within flange **12*a* is a sheet 16 of glass, plastic or other transparent material which fills the opening 12*b* through frame member 12 and forms a window for displaying a picture or photograph 18 positioned behind sheet 16. The picture 18 is backed up by one or more cardboard filler sheets 20 and the transparent sheet 16, picture 18 and filler sheet(s) 20 are held tightly against the back of frame member 12 within its flange 12*a* by a relatively rigid back panel 22. Panel 22** is releasably locked to the frame member in a manner to be described presently.

Preferably the rear face and edges of back panel 22 are covered by a suitable flexible finish sheet or coating 24, such as a sheet of felt fabric or flocking, to enhance the appearance of the rear face of the picture frame. Also, a leg 26 may be hinged to the rear face of the back panel 22 to enable picture frame 10 to stand upright on a flat surface as shown in FIG. 1. The back panel 22 may also be equipped with a hook or eye (not shown) near the top of the picture frame to enable the frame to be hung from a fastener on a wall or other vertical surface, with leg 26 then being swung against the rear face of back panel 22 as shown in phantom in FIG. 2.

Figure 3:
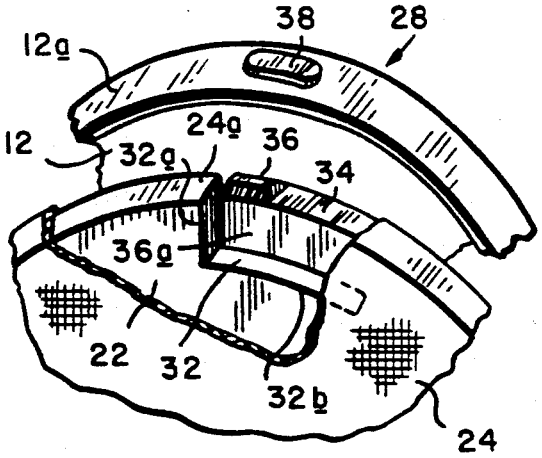
FIG. 3 is a fragmentary exploded isometric view on a much larger scale and with parts broken away illustrating the back panel locking mechanism in the FIG. 1 frame.
Figure 5:
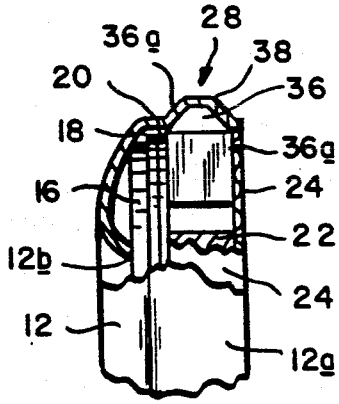
FIG. 5 is a fragmentary sectional view on a still larger scale taken along line 5—5 of FIG. 4.

Referring now to FIGS. 1 to 3, the back panel 22 is releasably secured to frame member 12 by resilient locking means shown generally at 28, the picture frame 10 having three of same, one being located at the top of the picture frame and the other two being located on opposite sides of the picture frame just above the feet 14. As best seen in FIG. 3, at the location of each locking means 28 is a generally L-shaped slot 32 in back panel 22. Each slot has a short leg **32*a* extending from the edge of back panel 22 toward the center of that panel and a long leg 32*b* which extends generally parallel to the panel edge. Each slot 32 thus defines a cantilevered arm 34 which follows and forms a part of the edge of back panel 22. Formed at the free end of each arm 34 is a tiny nub or projection 36 which projects out from the adjacent edge segment 22***a* of the back panel 22 through a small opening in finish sheet or coating 24. As best seen in FIGS. 3 and 5, the front and rear faces 36*a* of each nub 36 are inclined so that the nub is wedge-shaped for reasons to be described presently.

Figure 4:
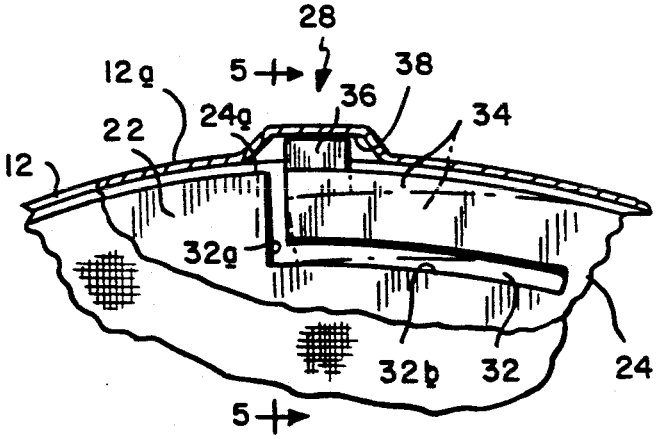
FIG. 4 is a fragmentary rear view on the same scale with parts broken away showing the operation of the locking mechanism.

As noted previously, the back panel 22 is made of a relatively rigid material so that each arm 34 thereof forms a flexible resilient cantilevered beam. In other words, when the free end of each arm 34 is pressed toward the center of the back panel, it will tend to snap back to its normal unstressed position. Thus the nub 36 at the free end of each arm 34 is actually an integral spring button at the edge of back panel 22. That is, nub 36 normally projects outward from the adjacent edge segment 22*a* of back panel 22 as shown in solid lines in FIG. 4. However, that nub can be depressed to an extent that it is flush with panel edge segment 22*a* as shown in phantom is FIG. 4. Obviously, the height of slot leg 32*b* must be great enough to allow such excursion of the free end of arm 34.

Still referring to FIG. 3, the other component of locking mechanism 28 is an outwardly extending dimple or depression 38 formed integrally in the inside wall of frame member flange 12*a* at a location thereon corresponding to the placement of a cantilevered nub 36 on back panel 22. In other words, when the picture frame 10 is fully assembled as shown in FIG. 1, there is a dimple 38 opposite each nub 36.

When the back panel 22 is positioned against the rear face of frame member 12, the inclined front face 36*a* of each nub 36 will engage the rear edge of the frame member flange 12*a*. As the two members are pressed together, a wedging action results which moves each cantilevered nub to its depressed position shown in phantom in FIG. 4. The finish sheet or coating 24 is sufficiently flexible or complaint so as not to interfere with the motion of arm 34 and its nub 36. In its depressed position, nub 36 clears the edge of picture frame flange 12*a* allowing the back panel to be seated against the frame member, or more particularly against the rearmost filler sheet 20. The nub 36 will be held in its depressed position by engagement with the inner face of flange 12*a* until the nub is brought opposite to the corresponding dimple 38 in the flange 12*a* . At that point, the nub is free to spring outwardly on its arm 34 to its solid line position shown in FIG. 4 so that the nub projects into the dimple 38 thereby forming interfitting means which lock the adjacent edge of back panel 22 to frame member 12. When all the nubs 36 are retained in their corresponding dimples, the back panel is securely locked to the frame member.

The front-to-back placement of each dimple 38 on the picture frame flange 12*a* is such that when the back panel 22 is locked to the frame member, the transparent sheet 16, picture 18 and filler sheet(s) 20 are sandwiched between the frame member and back panel. The tightness of the fit can be adjusted as needed by changing the thickness and/or number of filler sheets 20. Since the frame member 12 and back panel 22 are shaped to mate with one another, the positional tolerance of each nub 36 and its dimple 38 in the lateral direction, i.e. around the periphery of the picture frame, is not particularly critical. Accordingly is shown in FIG. 3, each dimple 38 may extend a short distance around the frame member flange 12*a* to ensure that it will be engaged by the corresponding nub 36 on back panel 22. Obviously, however, if the picture frame 10 were round, each dimple 38 should be made shorter to avoid relative circumferential motion of the frame member and back panel.

In order to unseat back panel 22 from frame member 12 when replacing a picture in the picture frame 10, one holds the frame member 12 in the area of a dimple 38 and presses the adjacent area of transparent sheet 16 rearward. This force presses the inclined rear face 36*a* of the corresponding nub 36 against the rear wall of that dimple 38 creating a wedging action which depresses that nub 36 sufficiently to allow the nub to clear the dimple thereby releasing the back panel 22 from the frame member 12 that location. Usually the release of one locking mechanism 28 is enough to allow the entire back panel to separated from the frame member. However, if there is a particularly tight fit between those members, it may be necessary to perform the same operation at a second dimple 38. In any event, it is a feature this invention that the components of the picture frame 10 may be assembled and disassembled many times without the locking mechanisms 28 losing there locking efficiency.

Also, while the illustrated picture frame 10 has three mechanisms 28, in some cases a single one may suffice. For example, the two lowermost nubs 36 on frame member 12 may be fixed, i.e. not mounted on cantilevered arms 34. In that event, the back panel may be assembled to the frame member 12 by inserting the two lowermost fixed nubs 36 into their corresponding dimples in the frame member flange 12*a* and then pressing the upper part of the back panel against the upper rear face of the frame member as described above to achieve locking engagement of the resilient nub 36 at the top of the back panel with its dimple 38 at the top of frame member 12.

Figure 6:
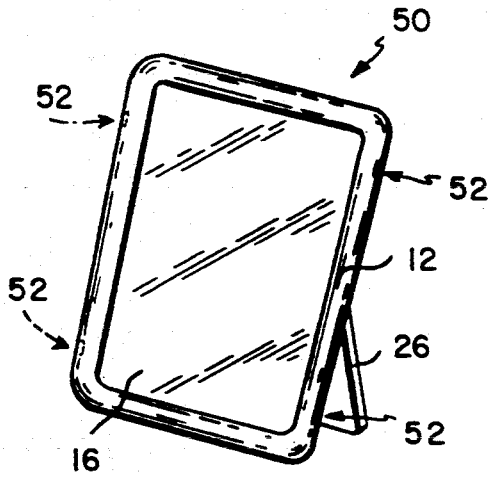
FIG. 6 is a view similar to FIG. 1 of another frame embodiment incorporating my invention.
Figure 7:
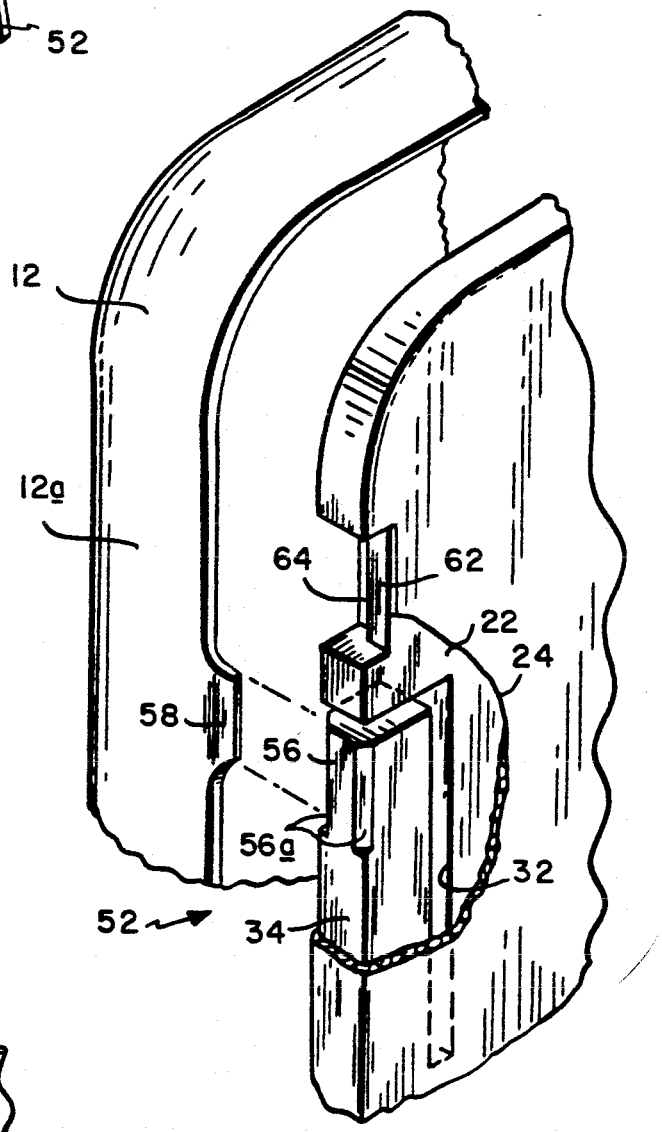
FIG. 7 is a view similar to FIG. 3 of the FIG. 6 frame and embodiment.
Figure 8:
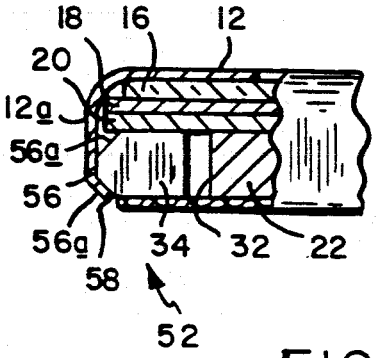
FIG. 8 is a view similar to FIG. 5 of a portion of the FIG. 6 frame embodiment.

Refer now to FIGS. 6 to 8 which disclose a rectangular picture frame 50 with a back panel locking mechanism 52 whose parts are more or less reversed from their positions in the FIG. 1 frame locking mechanism 28.

Except for the locking mechanism 52, all of the components of the picture frame 50 are similar to the corresponding components of the FIG. 1 frame and, therefore, they carry the same identifying numerals.

In this case, the frame member 12 and back panel 22 are rectangular, with the panel being releasably locked to the frame member by locking mechanisms 52, there being two such mechanisms 52 on each side of the frame where they are hardly visible when, as usual, the frame is viewed from the front looking down.

As in the FIG. 1 frame, each locking mechanism 52 comprises a cantilevered arm 34 defined by an L-shaped slot 32 in back panel 22. In this case, however, the nub at the face end of the arm is replaced by a flat end portion 56 of arm 34 which is flush with the edge of panel 22 when arm 34 is in its normal undeflected position shown in FIGS. 7 and 8. Bevels 56*a* are provided along the front and rear edges of arm portion 56.

The other component of locking mechanism 52 is an inward projection or nub 58 which replaces the outward dimple or depression on the FIG. 1 frame member. Each projection 58 is stamped into the rear edge margin of frame member flange 12*a* at a location such that it will engage the corresponding arm portion 56 in panel 22 when that panel is assembled to the frame member, the wedging action of the projection 58 against the forward beveled edge 56*a* of arm portion 56, depresses arm 34 so that the projection 58 can ride over arm portion 56. When the panel is fully seated, the projection will clear that portion 56 and engage behind that portion, as arm 34 returns to its undeflected position shown in FIGS. 7 and 8, thereby locking the panel in place.

The back panel 22 of the FIG. 50 frame is released as described above by pushing on the glass 16 adjacent to a locking mechanism 50, the rear bevel 56*a* at arm portion 56 facilitating such release. Otherwise, frame 50 is similar to frame 10 and has the same advantages discussed above for that frame.

Also, if desired, a lengthwise slot 62 may be provided in the edge of back panel 22 adjacent to the short leg 32*a* of the slot 32 therein.

Preferably, the forward half of slot 32 is made deeper than the rear half thereby forming an overhanging ledge 64. To release back panel 22, the edge of a coin may be inserted between frame member flange 12*a* and panel 22 at slot 62 and engaged under ledge 64. Pushing outward on the coin will jack the back panel 22 away from the frame member 12. Of course, similar slots 62 can also be formed in the back panel 22 of the FIG. 1 frame 10.

It will thus be seen that the objects set forth above, among those made apparent from the preceding description, are efficiently attained. Also, certain changes may be made in the above constructions without departing from the scope of the invention. For example, the rear wall of each dimple 38 may be inclined instead of the rear wall of the corresponding nub 36 to facilitate the nub being pushed out of the dimple when releasing the back panel 22. Therefore, it is intended that all matter contained in the above description or shown in the accompanying drawings shall be interpreted as illustrative and not in a limiting sense.

It is also to be understood that the following claims are intended to cover all of the generic and specific features of the invention herein described.

I claim:

1. A picture frame comprising an annular frame member defining a window and having a rearwardly extending peripheral imperforate flange with inner and outer surfaces;

a relatively rigid back panel whose outer edge has the same general outline as the frame member allowing said panel to seat snugly against the frame member within the frame member flange, each location around a perimeter of the frame member flange having a corresponding location around a perimeter of the back panel outer edge; and locking means for releasably locking the back panel to the frame member, said locking means including at least one inwardly projecting detent in the inner surface of the frame member flange at a selected location around the perimeter of said flange, and at least one resilient cantilevered arm having one end connected integrally to said panel, said arm extending generally parallel to the panel outer edge and having a free end segment at said corresponding outer edge location arranged to resiliently engage in front of said detent when the back panel is seated against the frame member.

2. The picture frame defined in claim 1 wherein said front and rear edges of said arm end segment are beveled.

3. The picture frame defined in claim 1 wherein said picture frame has a plurality of said locking means spaced around its perimeter.

4. The picture frame defined in claim 1 wherein each detent comprises a small inwardly-rearwardly projecting integral extension of the frame member flange.

* * * * *